US005143405A

United States Patent [19]

Daneshvar

[11] Patent Number: 5,143,405

[45] Date of Patent: Sep. 1, 1992

[54] BEARER MEDICAL INFORMATION BOOKLET

[76] Inventor: Yousef Daneshvar, 33200 Slocum, Farmington, Mich. 48024

[21] Appl. No.: 495,738

[22] Filed: Apr. 16, 1990

[51] Int. Cl.[5] ..... B42D 3/00

[52] U.S. Cl. ..... 281/31; 206/472; 150/147; 283/900

[58] Field of Search ..... 283/117, 75, 900; 150/147; 206/425, 472, 39.7; 281/29, 31

[56] References Cited

U.S. PATENT DOCUMENTS 4,621,729 11/1986 Jackson ..... 283/75 X
4,858,957 8/1989 Capozzola ..... 283/75 X

*Primary Examiner*—Timothy V. Eley
*Assistant Examiner*—William Fridie, Jr.

[57] ABSTRACT

A booklet that is intended to be carried by a person so as to be available to a health care provider when the person is in need of medical treatment. The booklet is intended to collect and present, in an orderly fashion, personal medical information that is potentially useful to the health care provider. The booklet comprises constructional features, namely pockets for receiving sheets of paper and/or glossy areas for adhesive-backed stickers, that allow for medical information to efficiently organized and presented, and to be updated as required.

11 Claims, 11 Drawing Sheets

Medical Passport

Name Sex M F

Last Middle First

Address

Number Street City State Zip Code

Occupation Retired ? S M D W Marital Status phone # Home ( ) - Bussiness ( ) -

Marriage state: Married Divorced Widowed

Name of Spouse: Phone #

Name of next of kin: Relation Phone #

Emergency Phone # ( ) - Persons Name to be contacted.

Phone # of close relative :

1. Relation: Home ( ) - Buss ( ) -

2. Home ( ) - Buss ( ) -

3.

Doctors Name last. First Phone # ( ) -

Address:

Medical Insurance Carrier

Primary Name Policy #

Preferred Hospital

Name Address

FIG. 10

Medical History: Date of last update of these information.

---

Family History:

Father:

Mother:

Brother or Sister:

History of Cigarette Smoker?

of Alcohol consumption?

of Drug Abuse?

Drug Allergies:

| | Name of Medicine: | type of reaction: |
|---|---|---|
| 1. | | |
| 2. | | |
| 3. | | |

| Name of Disease or Condition: | Date it was Found or Occurred |
|---|---|
| 1. | |
| 2. | |
| 3. | |
| 4. | |
| 5. | |
| 6. | |
| 7. | |
| 8. | |
| 9 | |
| 10. | |

FIG. 11

Operations:

| Type: | Date: | Place performed: | name of Surgeon. |
|---|---|---|---|
| 1. | | | |
| 2. | | | |
| 3. | | | |
| 4. | | | |
| 5. | | | |
| 6. | | | |

History of Transfusion:

| Date: | Amount: |
|---|---|
| | |
| | |

Medications:

| Name: | Dosages : | Amount of medicine to be taken every so many hrs or times a day |
|---|---|---|
| 1. | | |
| 2. | | |
| 3. | | |
| 4. | | |
| 5. | | |
| 6. | | |
| 7. | | |
| 8. | | |
| 9. | | |
| 10. | | |

Type of Diet:

FIG. 12

Remarks:

Is there anything special which you wish the Medical group to know and do for you? Please mention the way you like:

Results of Main Tests Performed such as Cardiac Catheterization: CAt scan of brain, Biopsy, etc

| Type of Test | Date | brief result |
|---|---|---|
| 1. | | |
| 2. | | |
| 3. | | |
| 4. | | |
| 5. | | |
| 6. | | |
| 7. | | |
| 8. | | |
| 9. | | |
| 10. | | |

Update:

The type setting of these informations will vary. And a light color will be used to allow typing of informations over them in order to save space.

FIG. 13

MEDICAL CHART

| NAME OF MEDICINE | SHAPE | | POSSIBLE SIDE EFFECTS | DOSAGE |
|---|---|---|---|---|
| | | | | |
| | | | | |
| | | | | |
| | | | | |
| | | | | |
| | | | | |
| DOCTOR APPOINTMENTS | | | | |
| TESTS | | | | |

FIG. 14

IMPORTANT CHART

| MAIN EVENT | DATE | THINGS TO BE DONE |
|---|---|---|
| | | |
| | | |
| | | |
| | | |
| | | |
| | | |
| | | |

FIG. 15

BEARER MEDICAL INFORMATION BOOKLET

FIELD OF THE INVENTION

This invention relates to a booklet that provides medical information about its bearer.

BACKGROUND AND SUMMARY OF THE INVENTION

As a practicing physician, I have observed that patients requiring medical treatment are sometimes unable to convey appropriate and accurate information about themselves to the health care provider at the time when the need for such information is greatest, such as after accidents loss of memory, state of confusion, etc. I have therefore invented a booklet that is intended to be carried by a person so as to be available to a health care provider when the person is in need of medical treatment. The booklet is intended to collect and present, in an orderly fashion, personal medical information that is potentially useful to the health care provider. As a physician, I believe that this booklet will prove to be a great service to some patients in these circumstances. The booklet comprises constructional features that allow for medical information to efficiently organized and presented, and to be updated as required.

U.S. Pat. No. 4,621,729 shows a prior art Patient Medical Information and Education Container.

Details of my invention will be explained by reference to the accompanying drawings and the ensuing description of a presently preferred embodiment in accordance with the best mode contemplated at this time for carrying out the invention.

BRIEF DESCRIPTION OF THE DRAWINGS

FIGS. 10–13 are four respective forms that can be used with my booklet.

FIGS. 14 and 15 are two respective charts that can be used with my booklet.

DESCRIPTION OF THE PREFERRED EMBODIMENT

Figure 1:
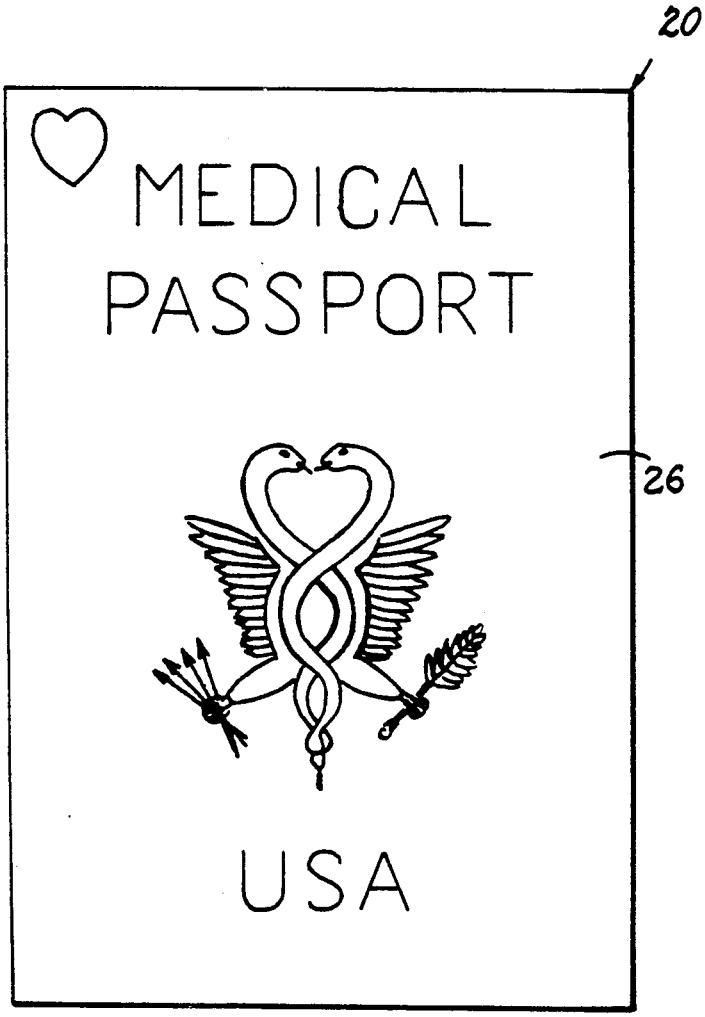
FIG. 1 is a view of the outside of the front cover of my booklet with the booklet closed.

When it is closed, my booklet 20 has a rectangular shape whose size is approximately four inches by six and one-eighth inches as shown in FIG. 1. When it is opened, as in FIGS. 2 and 3, the booklet has a size of approximately eight inches by six and one-eighth inches.

Booklet 20 comprises a front cover 22 and a back cover 24. The outside 26 of front cover 22 as shown in FIG. 1 contains my trademark "Medical Passport and Design". The covers are fabricated from a relatively thick material, such as paper, plastic, or leather, and may be colored or otherwise decorated as desired.

Figure 2:
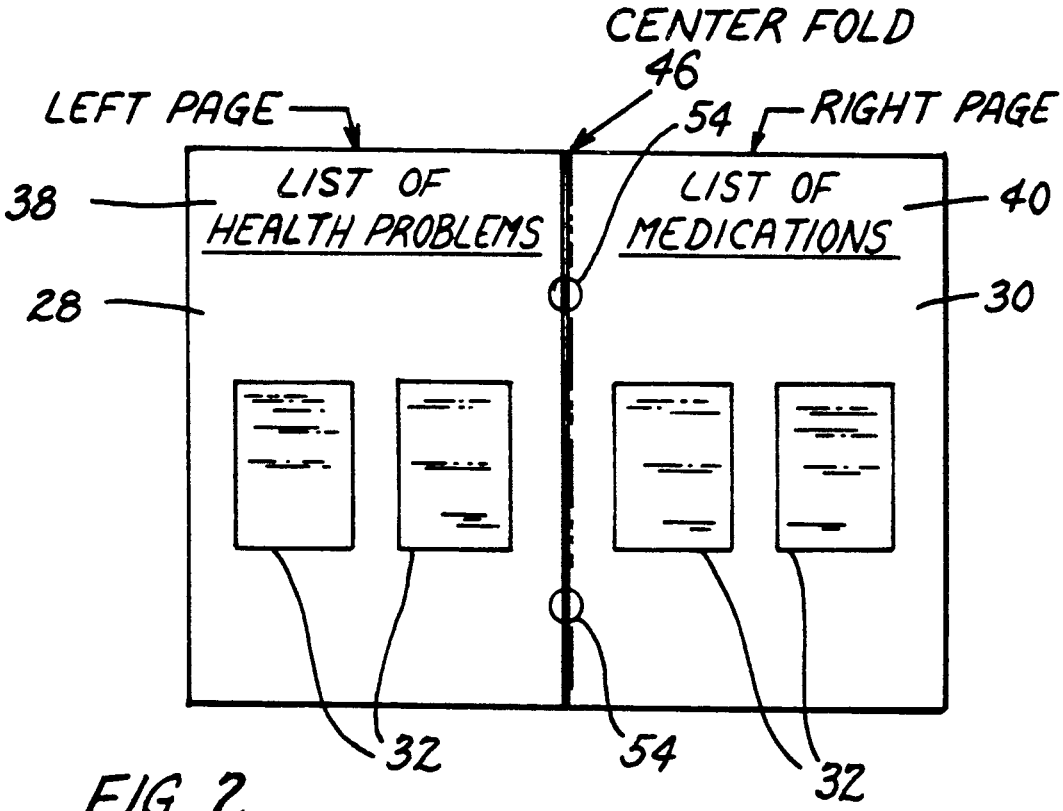
FIG. 2 is a view of the inside of the front and back covers of my booklet with the booklet opened.
Figure 3:
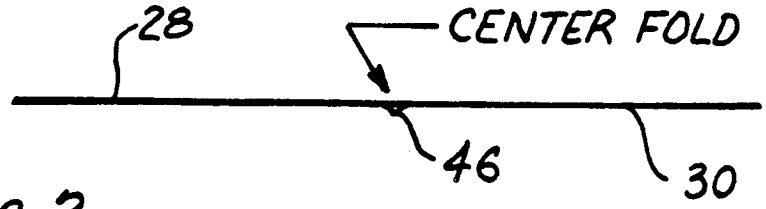
FIG. 3 is a bottom edge view of FIG. 2.
Figure 16:
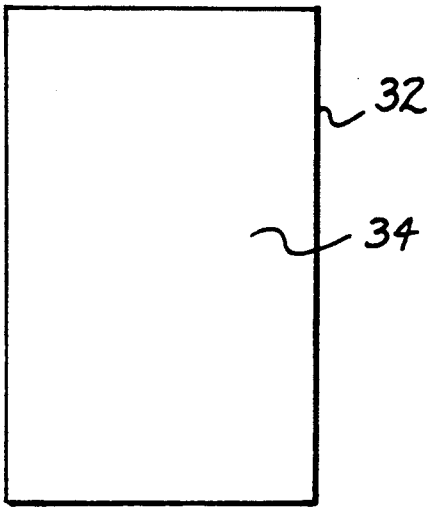
FIGS. 16 and 17 are the face and reverse sides of sheets that are used in association with my booklet.
Figure 17:
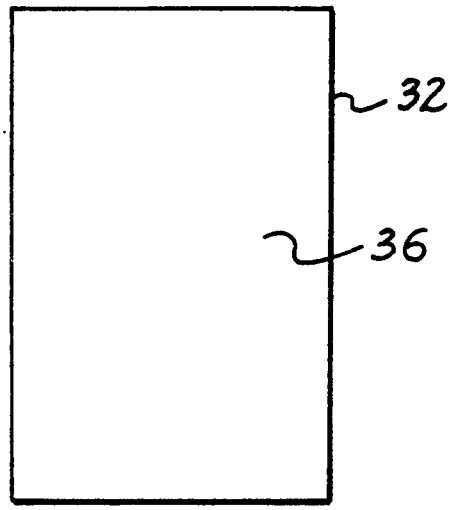

The surface finish of the inside 28 of the front cover 22 and that of the inside 30 of the back cover 24 allows an adhesive-backed sheet to be removably adhered thereto. Such an adhesive-backed sheet contains certain medical information about the person who is the bearer of the booklet. An example of such a sheet 32 is shown in FIGS. 16 and 17. FIG. 2 includes several such sheets mounted on insides 28 and 30.

The sheet 32 has a front face 34 onto which certain medical information about the bearer can be placed. Such information can be entered by typing. The back face 36 of sheet 32 contains adhesive that allows for it to be releasably adhered to inside 28 or 30 as the case may be. When the sheet 32 is so adhered, the information that appears on its front face will be presented when the booklet is opened to the condition of FIG. 2. By way of example, the size of such sheets may be 2–3 cm. by 10 cm.

The top of inside 28 contains the heading 38 "List of Health Problems", while the top inside 30 contains the heading 40 "List of Medications". Information relating to health conditions of the bearer may be entered on the face 34 of a sheet 32 and the sheet releasably adhered to inside 28 in the space below heading 38. Likewise information relating to medications taken by the bearer may be entered on the face 34 of another sheet 32 and that sheet releasably adhered to inside 30 in the space below heading 40. Thus when the booklet is opened, a list of the bearer's medical conditions and a list of his medications are presented on the respective insides of the front and back covers. By having the sheets releasably adhered in this manner the booklet may be easily updated by replacing an outdated sheet with a new sheet.

Figure 4:
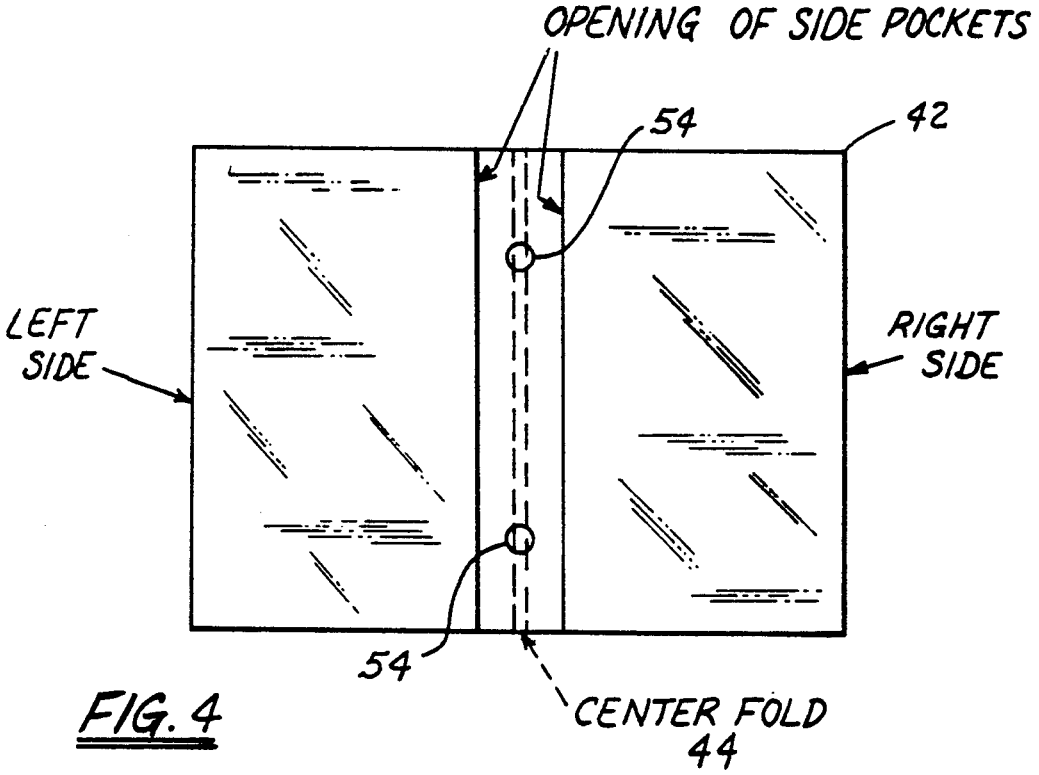
FIG. 4 is a view in the same direction as the view of FIG. 2 of certain interior pages for the booklet.
Figure 5:
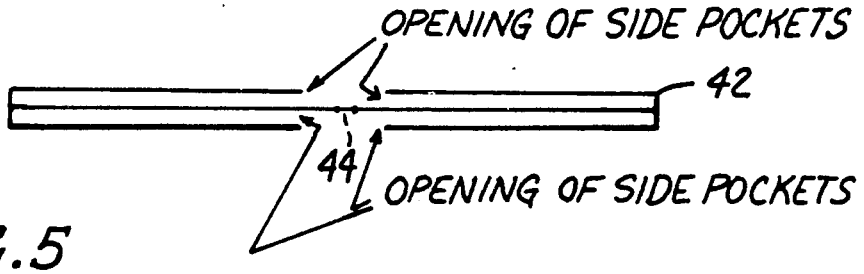
FIG. 5 is a bottom edge view of FIG. 4.

Additional information is presented by providing interior sheets for the booklet. A first type of interior sheet 42 is presented in FIGS. 4 and 5. It is a transparent plastic that contains a center fold line 44 that is adapted to be placed essentially coincident with the center fold line 46 that joins the front and back covers 22 and 24. FIGS. 4 and 5 show the opened condition. Sheet 42 provides four pages, and each page contains a rectangular pocket. Each pocket is closed along three sides and the remaining fourth side is open toward fold line 44. The pockets are adapted to receive sheets of information that are useful for the patient. Examples of such sheets are given in FIGS. 10 through 15.

FIGS. 14 and 15 can be adapted for use as charts which could be hung in the kitchen or in the bedroom. When appropriately prepared for such use, the chart of FIG. 14 will allow the shape of medications and their purpose, side effects, and dosages to be shown in an easy way. Such a chart may be made of thick board or plastic (for example, 9×12 inches) with a glossy face or special plastic to allow the frequent sticking and removal of adhesive-backed sheets (stickers) like those previously described. It will have different coloring in each part helping to associate one group of meds with its information and dosage—this will be done by coloring that section. It will have a section for marking the doctors' and dental appointments and the dates of tests, helping to organize the information in a more visible way. The background, colors, and shapes may vary in order to make a nice likeable chart. It will have a line for important numbers such as the doctors', immediate relatives' hospitals', etc.

Figure 8:
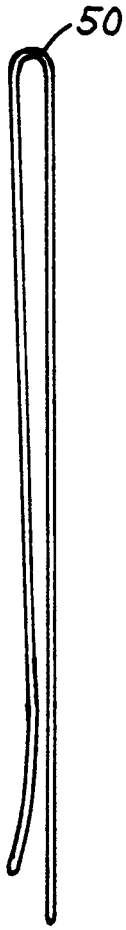
FIG. 8 is a view of a fastening device for use with my booklet.
Figure 9:
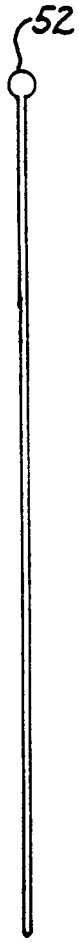
FIG. 9 is a view of another fastening device for use with my booklet.

A sheet such as 42 is separably assembled to the sheet that forms the front and back covers by placing the sheet 42 against the insides 28 and 30 with the lines of folding 44 and 46 essentially coincident. Then a device such as the spring clip 50 of FIG. 8 or the pin 52 of FIG. 9 is used to complete the attachment. The line of folding 46 contains a groove that allows the clip to be fitted over one of its lengthwise ends and to fit into the groove so as to hold the line of folding 44 of sheet 42 in the groove. Both lines of folding may have sets of registering holes 54 that when registered allow the pin 52 to be threaded through so as to join the sheet 42 to the sheet that forms the front and back covers.

Figure 6:
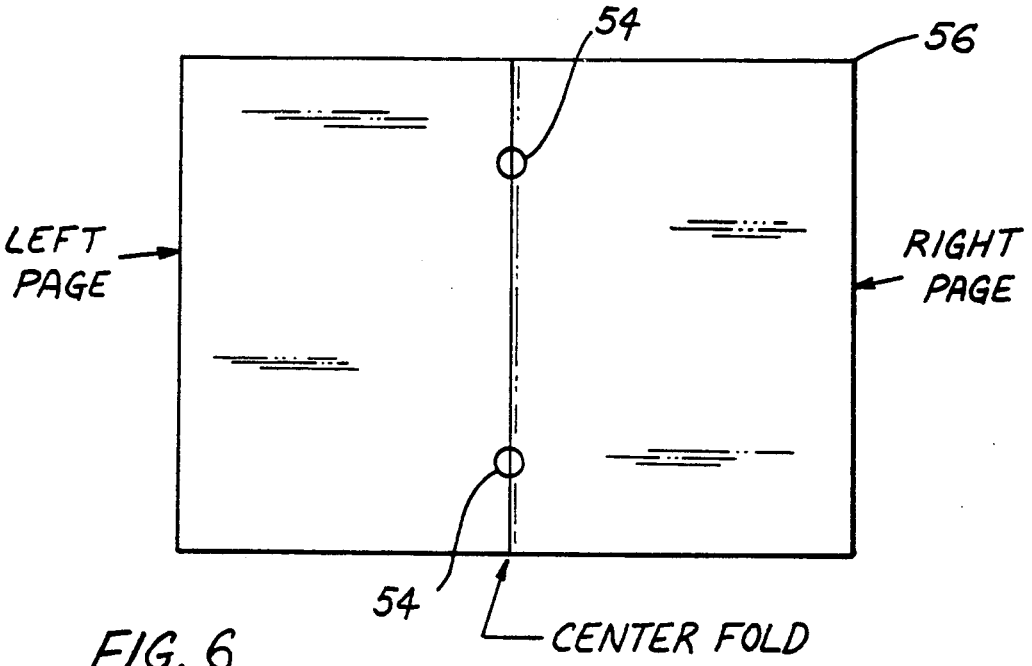
FIG. 6 is a view in the same direction as the view of FIG. 2 of certain other interior pages for the booklet.
Figure 7:
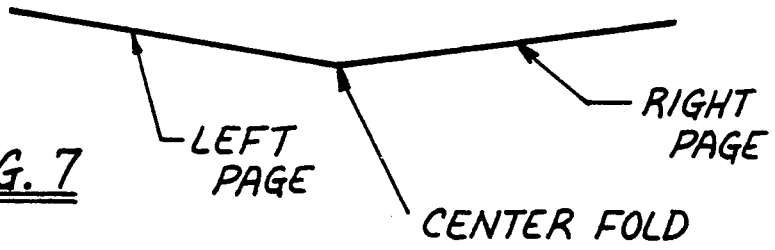
FIG. 7 is a bottom edge view of FIG. 6.

Another form of interior sheet is the sheet 56 of FIGS. 6 and 7. This sheet may be attached to the fold line of the front and back covers in the same manner as that just described for sheet 42. Sheet 56 may be a plastic or a paper with a surface finish that allows for the releasable adhering of adhesive backed sheets to it in the same manner described above for adhering adhesive-backed sheets to the insides of the front and back covers. The adhesive backed sheets that are releasably adhered to a sheet such as 56 may contain additional medical information about the bearer. It may also be used to contain small picture of actual medications, tablets, capsules, etc. It could also be used to explain the use and side effects and dosages of medications in brief language.

The interior sheets can also have background printing and necessary information typed on them.

Figure 18:
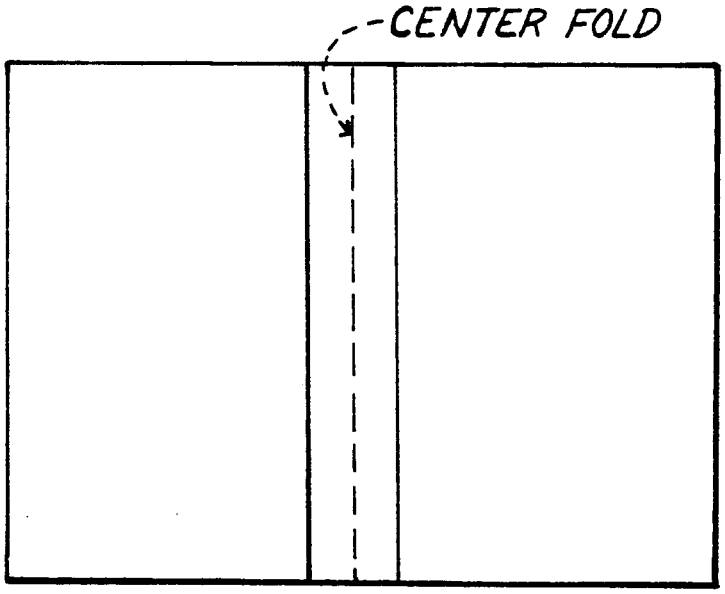
FIGS. 18 and 19 are views corresponding to FIGS. 2 and 3, but presenting an alternate embodiment.
Figure 19:
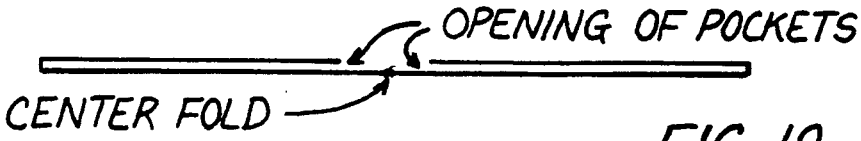

FIGS. 18 and 19 show another embodiment of my booklet which comprises front and back covers 22 and 24. The insides of these covers contain pockets into which sheets of paper containing medical informations relating to the person, such as previously described earlier, can be inserted. They can be updated by removal and updating, or else by removal and replacement by new sheets.

In conclusion, my booklet provides a summary of pertinent medical information about an individual in a uniform organized way. It can be easily updated, as required. It can be an aid in assisting a health care provider to furnish proper care, and it could possibly even save lives in certain situations by providing timely information about the patient.

What is claimed is:

1. A booklet for containing personal medical information about the bearer of the booklet, said booklet comprising a front cover and a back cover that are joined by a line of folding to allow the front and back covers to be opened and closed, and an area of the inside of each of said covers comprising receiving means for receiving sheet material, and said booklet further including sheet material containing medical information about the bearer removably received on said receiving means, said booklet including one or more interior sheets each having an edge that is substantially coincident with said line of folding so as to form a leaf of the booklet which also folds about said line of folding and which contains additional medical information about the bearer, and in which said one or more interior sheets includes a transparent plastic containing a pocket into which is removably inserted an information sheet containing at least some of the additional medical information about the bearer.

2. A booklet as claimed in claim 1 in which said pocket is closed along three sides and open along a fourth side, said fourth side being toward said line of folding.

3. A booklet as claimed in claim 1 in which said transparent plastic comprises a centerfold of transparent plastic arranged so as to form two leaves of the booklet, each leaf comprising pockets on opposite sides thereof.

4. A booklet as claimed in claim 1 in which said one or more interior sheets are held in assembly with said covers by means of an elongated clip that fits over an end of said line of folding to run along the length of a groove formed by said line of folding and that holds said one or more interior sheets against said line of folding.

5. A booklet as claimed in claim 1 in which said one or more interior sheets are held in assembly with said covers by means of an elongated pin that passes through holes in said line of folding.

6. A booklet as claimed in claim 1 in which the inside of one of said covers contains indicia identifying a heading under which information about medical problems of the bearer can be entered and the inside of the other of said covers contains indicia identifying a heading under which information about medications taken by the bearer can be entered.

7. A booklet a claimed in claim 1 in which said inside of each cover comprises for said receiving means a corresponding pocket containing a corresponding sheet containing certain medical information about the bearer.

8. A booklet for containing personal medical information about the bearer of the booklet, said booklet comprising a front cover and a back cover that are joined by a line of folding to allow the front and back covers to be opened and closed, and an area of the inside of each of said covers comprising receiving means for receiving sheet material, and said booklet further including sheet material containing medical information about the bearer removably received on said receiving means, said booklet including one or more interior sheets each having an edge that is substantially coincident with said line of folding about said line of folding and which contains additional medical information about the bearer, and in which said one or more interior sheets comprises a further area comprising a surface finish that allows an adhesive-backed sheet to be removably adhered thereto, and such an adhesive-backed sheet containing certain further medical information about the bearer removably adhered to said further area.

9. A booklet as claimed in claim 8 in which said one or more interior sheets comprises indicia thereon identifying particular categories of certain further medical information about the bearer, and spaces associated with said categories for receiving medical information about the bearer in each of said categories.

10. A booklet as claimed in claim 9 in which each of said spaces comprises a surface finish that allows an adhesive-back sheet to be removably adhered thereto, and an adhesive-backed sheet containing certain medical information about the bearer in the corresponding category removably adhered to the corresponding one of said spaces.

11. A booklet for containing personal medical information about the bearer of the booklet, said booklet comprising a front cover and a back cover that are joined by a line of folding to allow the front and back covers to be opened and closed, and an area of the inside of each of said covers comprising receiving means for receiving sheet material, and said booklet further including sheet material containing medical information about the bearer removably received on said receiving means, and in which said inside of each cover comprises for said receiving means a corresponding space comprising a surface finish that allows an adhesive-backed sheet to be removably adhered thereto, and one or more adhesive-backed sheets containing medical problem information about the bearer removably adhered to said space of the inside of one of said covers, and one or more adhesive-backed sheets containing information about medications taken by the bearer removably adhered to said space of the inside of the other of said covers.

* * * * *